US005956067A

United States Patent [19]

Isono et al.

[11] Patent Number: 5,956,067

[45] Date of Patent: Sep. 21, 1999

[54] THERMAL TRANSFER PRINTING DEVICE AND METHOD

[75] Inventors: Hajime Isono; Shin'ichiro Chiba; Toshihito Shiina; Takehito Kobayashi; Hiroshi Mochizuki; Masahide Shirasu, all of Yamanashi-ken, Japan

[73] Assignee: Nisca Corporation, Yamanashi-ken, Japan

[21] Appl. No.: 08/329,197

[22] Filed: Oct. 26, 1994

[30] Foreign Application Priority Data

| | | | |
|---|---|---|---|
| Oct. 28, 1993 | [JP] | Japan | 5-292758 |
| Oct. 28, 1993 | [JP] | Japan | 5-292760 |
| Oct. 28, 1993 | [JP] | Japan | 5-292761 |
| Oct. 28, 1993 | [JP] | Japan | 5-292762 |

[51] Int. Cl.[6] ..... B41J 2/325; B41J 2/36; B41J 2/38

[52] U.S. Cl. ..... 347/176; 347/191; 347/212

[58] Field of Search ..... 400/82, 120.01, 400/120.02, 120.04, 120.11; 347/171, 172, 173, 174, 176, 217, 191, 212

[56] References Cited

U.S. PATENT DOCUMENTS

| | | | |
|---|---|---|---|
| 5,153,605 | 10/1992 | Ohara et al. | 347/191 |
| 5,167,456 | 12/1992 | Murakushi et al. | 347/172 |
| 5,220,343 | 6/1993 | Takanshi et al. | 347/212 |
| 5,599,765 | 2/1997 | Oshima et al. | 503/227 |
| 5,611,629 | 3/1997 | Paranjpe | 347/172 |
| 5,636,928 | 6/1997 | Shiina et al. | 347/174 |

OTHER PUBLICATIONS

Japanese Patent Publication No. HEI 4–44865 (1992) (Corresponding to Japanese Patent Application Publication No. SHO 60–32472) (1985) Cited in the specification.

Japanese Patent Application Publication No. SHO 60–54870 (1985).

Japanese Patent Application Publication No. SHO 60–154093 (1985) Cited in the specification.

Japanese Patent Application Publication No. SHO 61–154972 (1986) Cited in the specification.

Japanese Patent Application Publication No. SHO 62–169679 (1987) Cited in the specification.

Japanese Patent Application Publication No. SHO 63–107574 (1988) Cited in the specification.

Japanese Patent Application Publication No. SHO 63–302072 (1988).

Japanese Patent Application Publication No. HEI 1–122485 (1989) Cited in the specification.

Japanese Patent Application Publication No. HEI 1–127379 (1989) Cited in the specification.

Japanese Patent Application Publication No. HEI 2–4565 (1990) Cited in the specification.

(List continued on next page.)

*Primary Examiner*—Huan Tran

*Attorney, Agent, or Firm*—Kane,Dalsimer,Sullivan,Kurucz,Levy,Eisele and Richard, LLP

[57] ABSTRACT

A thermal transfer printing device for printing photorealistic color images with dye-sublimation inks of different colors and two-gradation images such as character and bar code patterns with a monochrome thermal wax-transfer ink respectively in separated printing sections. The bar code pattern is printed in the widthwise direction of the code bars with heating energy smaller than that for printing the bar code pattern in the lengthwise direction of the bars, thus increasing the reproductivity in producing the bar code pattern. Deviations in specific resistance among heating elements of a thermal print head can be compensated by multiplying image data energy to be supplied to the heating elements by ratios of the specific resistance of the respective heating elements to the maximum resistance in the heating elements, thus producing high-quality images on the recording medium.

14 Claims, 11 Drawing Sheets

OTHER PUBLICATIONS

Japanese Patent Application Publication No. HEI 3–67665 (1991) Cited in the specification.

Japanese Patent Application Publication No. HEI 3–275362 (1991).

Japanese Patent Application Publication No. HEI 3–278976 (1991).

Japanese Patent Application Publication No. HEI 4–299153 (1992).

Japanese Patent Application Publication No. HEI 4–299166 (1992).

CPU
31
Frame Memory
32
33
Printing Area Decision Circuit
35a
Compensation Circuit
35b
34
37
δ1
δi
δn
R1
Ri
Rn
Resistance Value Setting Circuit (ROM)
36
38
P/S Converter
39
14
PA
Pe
Ps
C

THERMAL TRANSFER PRINTING DEVICE AND METHOD

BACKGROUND OF THE INVENTION

1. Field of the Invention

This invention relates to a thermal transfer printing device and method for effectively printing photo-quality images such as a full-color photograph by use of dye-sublimation inks of different colors and two-gradation images such as character and bar code patterns by use of a thermal wax-transfer ink on a recording medium.

2. Description of the Prior Art

A variety of identification cards such as a credit card, on which two-gradation patterns including characters and codes are printed with a full-color photograph of user's face, are in general use. A printer therefor is required to reproduce various images created by use of a computer or the like on a recording medium such as a plastic card base with high resolution and accuracy.

A thermal transfer printer capable of high-quality printing is relatively simple in handling and structure, and therefore, has been widely used. The thermal transfer printer are grouped into a thermal wax-transfer type and a dye-sublimation type according to the kind of a printing ink for use in printing. The printing ink applied onto a printing ribbon is fused or sublimated by a thermal print head with an array of heating resistance elements while being pressed against the recording medium, thus producing desired images on the recording medium.

Since the dye-sublimation ink comprising a sublimating dye is transferred with subtle grayscales by supplying minutely controlled heating temperature corresponding to the gradation of a given image, it is suitable for producing a pictrial or photorealistic images. When printing a full-color photorealistic image, the inks of at least three primary colors (yellow, magenta, and cyan) are used to represent all colors and gradations by a subtractive color mixture method. The photorealistic printouts having smooth color gradations can be produced by repeating a single color printing three times.

The thermal wax-transfer type ink is suited to printing of a two-gradation (black-and-white) images because of its narrow temperature range of phase transition. That is, the two-gradation images having definite outlines, such as characters and lines, can be represented by pointillistic (black and white) dots produced by applying binary driving currents to the respective heating resistance elements of a thermal print head.

The thermal wax-transfer ink may be applied for producing a photographic image, but the resultant photographic print outputs have too much contrast without much in the way of halftones.

The ink ribbon used in the thermal transfer color printers comprises a long strip of plastic film base and multiple-color inks applied to the respective frames successively defined on the film base. One example of the conventional ink ribbons with three color inks is disclosed in ① Japanese Patent Application Publication No. SHO 63(1988)-107574.

In the thermal transfer printers disclosed in ② Japanese Patent Application Publication No. SHO 60(1985)-32472, and ③ Japanese Pat. Appln. Publication No. SHO 60(1985)-154093, four-color printing is performed by use of color inks of the three primary colors plus a black color for printing characters. In ④ U.S. Pat. No. 4,660,051 to Eiichi Sasaki and ⑤ Japanese Pat. Appln. Pub. No. HEI 3(1991)-67665, a white ink for background printing is further used.

When printouts having a combination of multi-gradation images such as a photograph and monochrome patterns including characters, e.g. an ID card with a photograph of user's face, are produced, a thermal transfer printer capable of monochrome thermal wax-transfer printing and dye-sublimation printing has been used. In ⑥ Japanese Pat. Appln. Pub. No. HEI 2(1990)-4565, an ink ribbon to which dye-sublimation color inks and a black thermal wax-transfer ink are applied together is adopted so that a multi-gradation image including a photograph is printed with the dye-sublimation color inks and a monochrome image such as characters is printed with the black thermal wax-transfer ink.

Because the dye-sublimation ink is fugitive, a printed surface of the recording medium is generally coated with a transparent protective layer. On that account, an ink ribbon with such a protective layer in addition to the printing inks has been used. (⑦ Japanese Pat. Appln. Pub. No. SHO 62(1987)-169679, ⑧ Japanese Pat. Appln. Pub. No. HEI 1(1989)-122485, ⑨ Japanese Pat. Appln. Pub. No. HEI 1(1989)-127379, and ⑩ U.S. Pat. No. 4,738,555 to Masayoshi Nagashima).

A printer using a protective layer ribbon separately from a color ink ribbon is disclosed in ⑪ U.S. Pat. No. 5,266,969, and ⑫ Japanese Pat. Appln. Pub. No. SHO 61(1986)-154972, for example.

In brief, the prior art thermal transfer printers may be roughly assorted into a printer using a single ink ribbon with multiple color inks (①~⑤), a printer using a single ink ribbon with thermal wax-transfer and dye-sublimation inks (⑥), a printer using a single ink ribbon with multiple color inks and an ink protective layer (⑦~⑩), and a printer using an ink ribbon plus a protective layer ribbon (⑪ and ⑫).

However, the conventional thermal transfer printers as described above involve various problems to be solved. To be more specific, in the case of printing images by use of the single thermal ink ribbon having the successively arranged thermal wax-transfer and dye-sublimation inks by operating a single thermal print head to heat, either of the thermal wax-transfer and dye-sublimation inks is deteriorated in ink-transfer performance because they are different in reaction temperature and transferring property. As a result, satisfactory print outputs cannot be produced. Therefore, in this thermal wax-transfer/dye-sublimation combined type printer, the thermal print head should be operated at different temperatures for severally fusing the thermal wax-transfer ink and sublimating the dye-sublimation ink to transfer the respective inks to the recording medium under suitable conditions. However, such a printer has a common disadvantage of necessitating a complex controlling system for driving the thermal print head so as to be of no practical utility.

In addition, the transferring conditions under which the thermal transfer inks are fused or sublimated and the transferring properties of the inks, which are specified by the behavior of the ink ribbon upon fusing or sublimating of the ink by the thermal print head, are fundamentally different between the thermal wax-transfer ink and dye-sublimation ink. That is, there is a burdensome possibility that the thermal transfer ink fails to be transferred to the recording medium, the ink ribbon cannot be successfully separated from the print head immediately after the ink on the ink ribbon is transferred to the recording medium by the heat generated by the print head, and the ink ribbon per se melts by the heat of the print head.

Meanwhile, the heating resistance elements of the thermal print head essentially show heat hysteresis by which the heat generated rises and lowers with some degree of delay. Furthermore, the heating resistance element being activated to heat is thermally affected by the adjacent heating element out of operation, consequently to cause the heat generated by the active heating element to diffuse to the adjacent resting element.

The heat hysteresis of the heating element of the print head becomes a serious problem particularly when accurate lines having significant meanings in line width, such as a bar code pattern, are printed. That is, the heat generated by the active heating element cannot soon cool down even when a power source for driving the heating element is switched off. Thus, the line printed by moving the thermal print head in the widthwise direction of the line becomes fat compared with printing in the lengthwise direction of the line. To be concrete, in producing a bar code pattern by the thermal transfer printer, a code bar printed by moving the thermal print head in the widthwise direction usually becomes 1.4 times width as that printed by moving the head in the lengthwise direction under the same conditions. This difference in width cannot be neglected.

Moreover, the heat hysteresis of the heating element is a determent to the image quality. For example, when printing a two-gradation image having definite outlines, the outlines of a resultantly produced image become obscure because the heat of the heating element actuated to depict the outlines is absorbed by the adjacent heating element out of operation.

There are some other causes for deterioration of the image quality of the print outputs. One of the causes is inevitable deviations in specific resistance among the heating resistance elements constituting the thermal print head, as it is technically impossible to make the heating elements strictly equal in resistance. Thus, when producing a colored image represented by subtle halftones such as a photograph, the deterioration of image quality becomes conspicuous with increasing the deviations in specific resistance among the heating elements of the print head. In some cases, shading stripes appear as image noises in the print outputs.

The thermal head having a degree of ±12% in deviation of resistance among the heating elements is generally permissible. However, in a case of the printer having ability to render 255 grayscales, about 30 grayscales are sacrificed due to the permissible deviation of ±12%. As a result, an image is possibly reproduced substantially in the range of only 225 grayscales by use of the thermal print head commonly incorporated in the conventional thermal transfer printer.

Thus, there has been a need for a thermal transfer printer capable of effectively printing high-quality photorealistic images and two-gradation images such as character and bar code patterns on a recording medium.

OBJECT OF THE INVENTION

This invention is made to eliminate the drawbacks suffered by the conventional thermal transfer printers as described above and has an object to provide a thermal transfer printing device and method capable of effectively printing high-quality photorealistic full-color images and two-gradation images such as characters on a recording medium.

Another object of this invention is to provide a thermal transfer printing device and method capable of producing high-quality images having different gradations by selectively and effectively using dye-sublimation inks of different colors and a thermal wax-transfer ink under the most favorable conditions suitable for the respective inks.

Still another object of this invention is to provide a thermal transfer printing device and method capable of producing lines or bars closely conforming to a given original pattern, thus enabling high-quality bar code patterns or other line patterns having prescribed line widths and intervals to be printed with a high accuracy, regardless of the directional situations of the patterns.

Yet another object of this invention is to provide a thermal transfer printing device and method capable of effectively compensating deviations in resistance of heating resistance elements constituting a thermal print head by use of a simple processing system so as to produce high-quality images with smooth grays and true gradations.

A further object of this invention is to provide a thermal transfer printing device and method provided with a heating system in which heating resistance elements constituting a thermal print head acquire little thermal influence from the respective adjacent elements so as to produce high-quality sharp images having clear and definite outlines.

SUMMARY OF THE INVENTION

To attain the objects described above according to the present invention, there is provided a thermal transfer printing device comprising a first printing unit including a first transfer ribbon having dye-sublimation inks of different colors and a first thermal print head for thermally transferring the dye-sublimation inks to a recording medium, and a second printing unit including a second transfer ribbon having a thermal wax-transfer ink and/or a protective layer and a second thermal print head for thermally transferring the thermal wax-transfer ink and/or transparent protective layer to the recording medium. The second transfer ribbon may include a thermally transferable hologram film. The dye-sublimation inks may be of at least three primary colors.

In the first printing unit, while pressing the first transfer ribbon against the recording medium such as a plastic card, the dye-sublimation inks are thermally transferred to the recording medium by activating the first thermal print head at a first printing place so as to produce multi-gradation full-color images such as a photograph. In the second printing unit, while pressing the second transfer ribbon against the recording medium on which the colored images are printed by the first printing unit, the thermal transfer ink is thermally transferred to the recording medium by activating the second thermal print head at a second printing place under the printing conditions different from that in the first printing unit, thereby to produce two-gradation images or patterns such as characters and lines. Optionally, the recording medium may be further printed with the thermally transferable hologram film. Finally, the printed face on the recording medium is coated with the protective layer by the second printing unit.

The run-off angles at which the first and second transfer ribbons passing through the printing places each are separated from the recording medium are independently determined according to the transferring properties of the inks on the respective ribbons, so that the transfer ribbons thermally affected by the thermal print heads can be successfully separated from the thermal print head after passing through the printing places, as a result of which the inks can be stably and reliably fixed on the recording medium.

In printing a bar code pattern formed of slender lines having significant meanings in line width and interval, heating energy to be supplied to the thermal print head when printing the bar code pattern in the widthwise direction of the constituent lines is lessened relative to that when printing the bar code pattern in the lengthwise direction, whereby the bar code pattern having prescribed line width and interval can be printed with a high accuracy regardless of the directional situation of the bar code pattern.

By multiplying the specific resistance value of heating elements constituting the thermal print head by the ratios of the deviations in resistance among the heating elements to the maximum resistance of the heating elements, the heating elements can be actuated with appropriate heating energy corresponding to gradations in given original images, thus producing print outputs closely conforming to the original images.

To lessen diffusion of the heat generated by the heating element operated to depict the outline of the image, the minimum driving current representing the minimum gradation is supplied to non-operating heating element adjacent to the heat element in action, thereby producing sharp images with clear and definite outlines.

Other and further objects of this invention will become obvious upon an understanding of the illustrative embodiments about to be described or will be indicated in the appended claims, and various advantages not referred to herein will occur to one skilled in the art upon employment of the invention in practice.

DESCRIPTION OF THE PREFERRED EMBODIMENTS

The present invention will become more fully understood from the detailed description given hereinbelow and the accompanying drawings which are given by way of illustration only, and thus are not limitative of the present invention.

The present invention relates to a thermal transfer printer comprising dual printing units. In the first printing unit, photorealistic images are produced on a recording medium such as a plastic card by use of a first transfer ribbon having dye-sublimation inks of different colors, and in the second printing unit, two-gradation images (black-and-white images) such as characters or code bars are produced on the same recording medium as above by use of a second transfer ribbon having a thermal wax-transfer ink, and then, the recording medium is coated with a transparent protective layer. The printing operations in the first and second printing units are performed under different conditions suitable for the respective dye-sublimation and thermal wax-transfer inks, thus producing high-quality images including, for example, a photograph and a bar code pattern in combination on the plastic card.

Although the plastic card applicable to credit cards, ID cards and so forth is applied as the recording medium, the shape and material of such a recording medium are by no means limitative; namely, the recording medium may of course have any other shape.

The printer according to this invention includes a first printing section S1 in which photo-quality full-color images and so on having multiple gradations, e.g. 255 grayscales, are printed on a card C used as the recording medium, and a second printing section S2 in which two-gradation images such as characters and code bars are printed on the same card.

Figure 1:
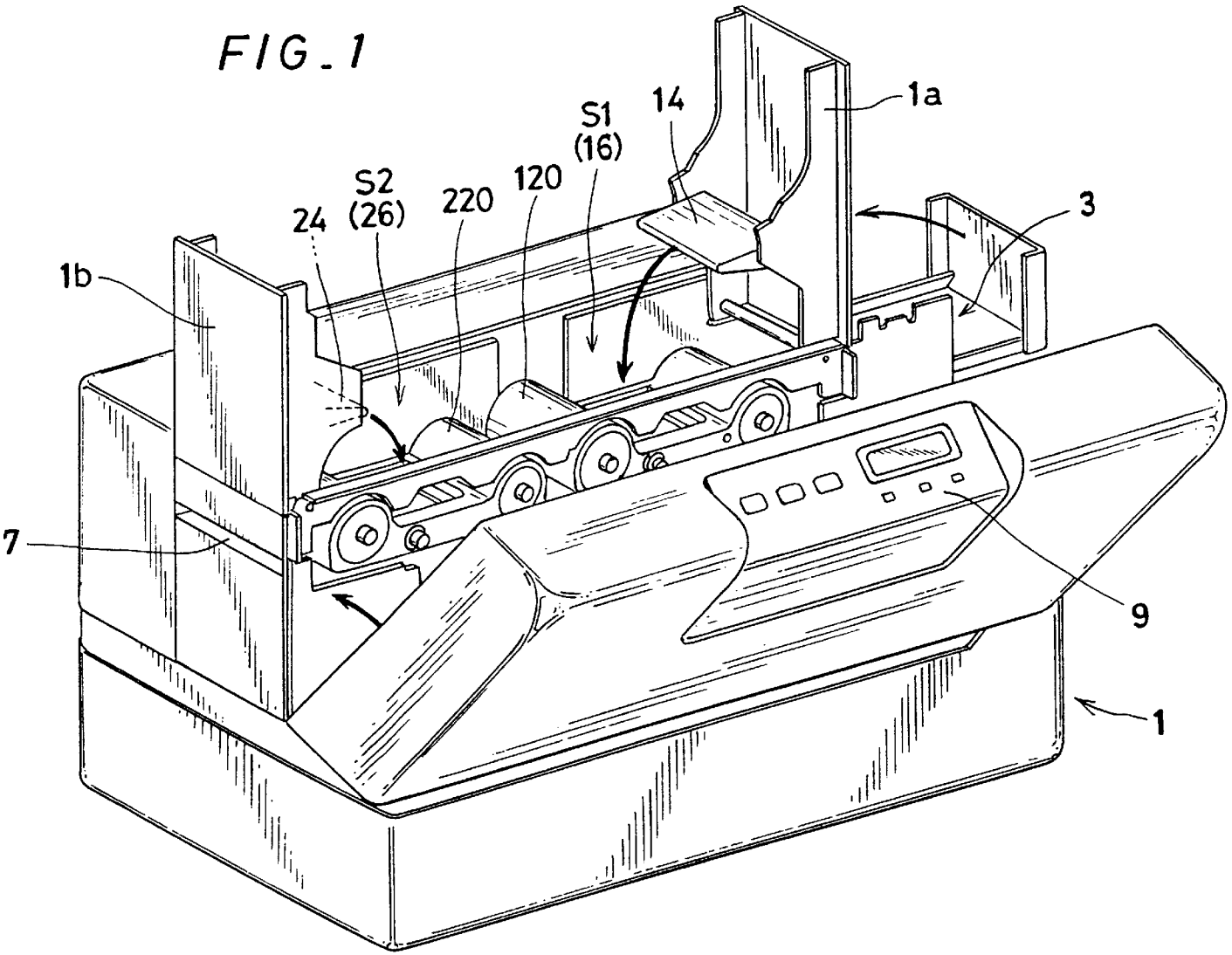
FIG. 1 is a perspective view of one embodiment of a thermal transfer printer according to this invention.
Figure 2:
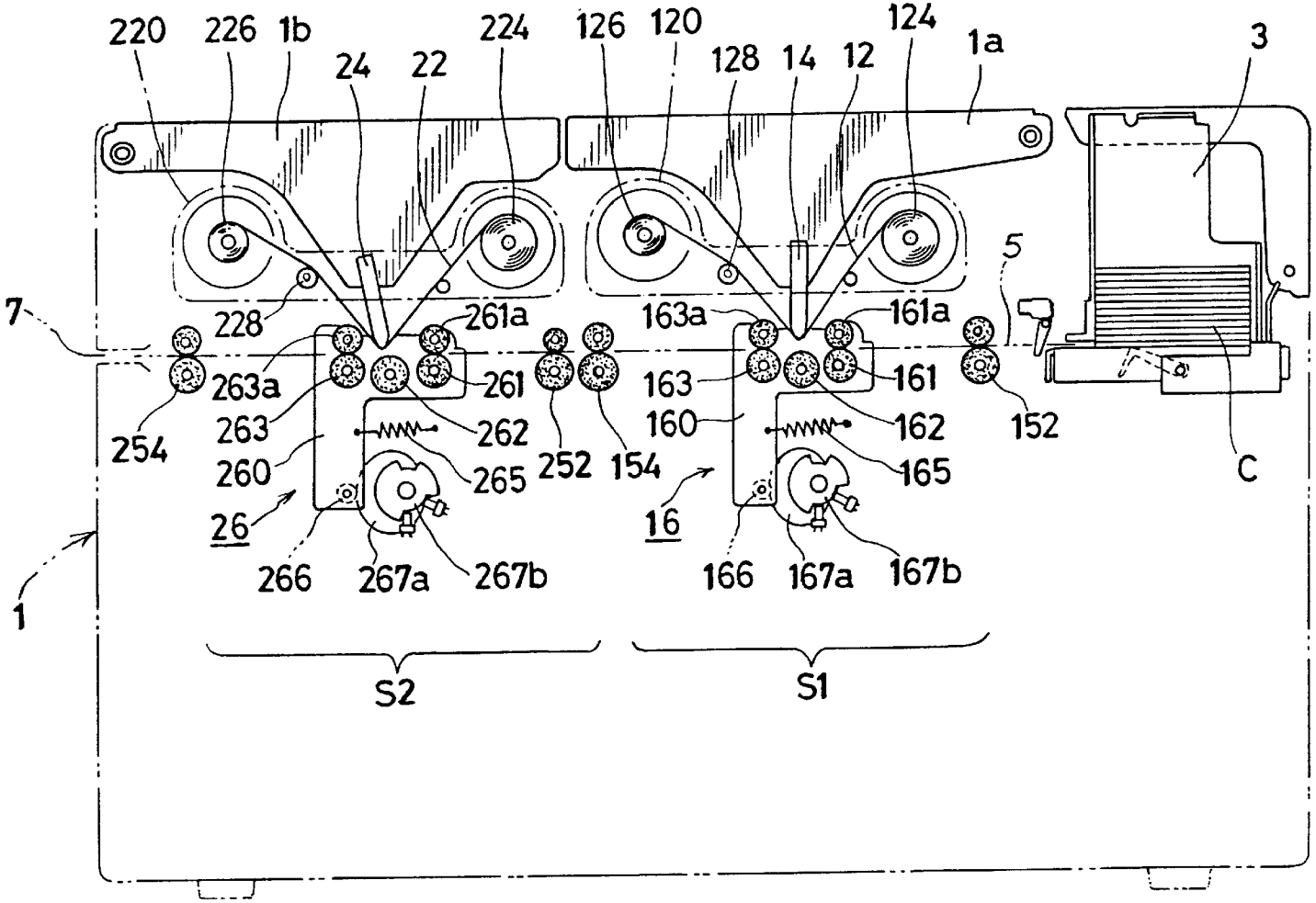
FIG. 2 is a side view schematically showing the interior of the printer of FIG. 1.
Figure 3:
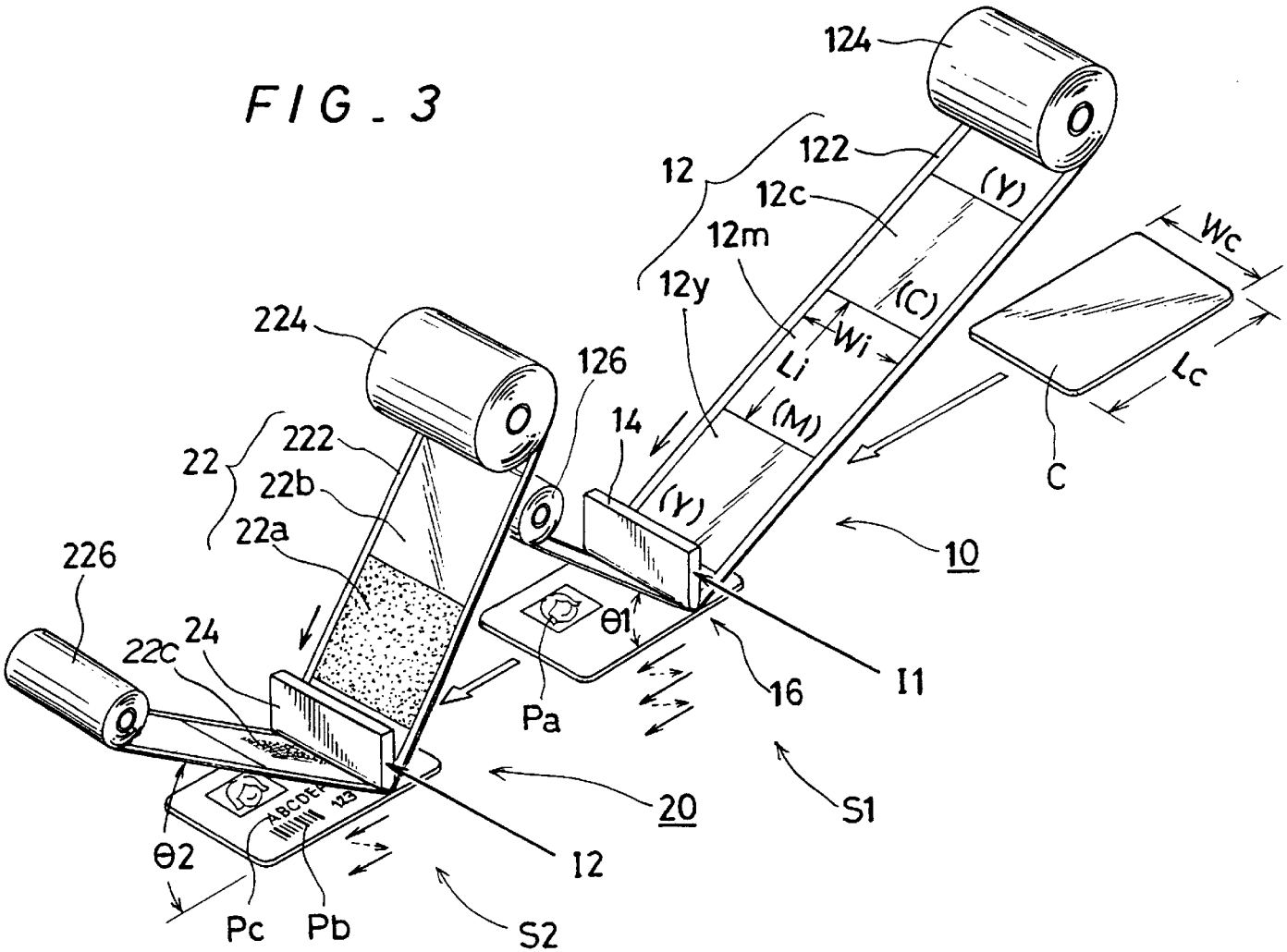
FIG. 3 is an explanatory view conceptually showing the printing principle of this invention.

The first printing section S1 and second printing section S2 are defined in a printer body 1 as shown in FIGS. 1 and 2. The printer body 1 includes a card supply unit 3 in which one or more blank cards still to be printed are stacked so as to be fed one by one toward the first printing section S1 through a transport path 5. As shown in FIG. 3, a photo-quality image Pa is printed on the card C fed from the card supply unit 3 at the first printing section S1, and a line pattern Pb such as a bar code pattern and characters Pc are printed at the second printing section S2. The printed card is finished by being coated with a transparent protective layer at the second printing section S2, and then, discharged from the printer body 1 through a card exit 7. In FIG. 1, reference numeral 9 denotes an operator control panel.

The printing principle of the present invention will be described with reference to FIG. 3 conceptually illustrating the first and second printing sections.

In the first printing section S1, there is disposed the first printing unit 10 comprising a first transfer ribbon 12 with a plurality of dye-sublimation color inks 12*y*, 12*m* and 12*c*, and a first thermal print head 14 for heating the transfer ribbon 12 to sublimate and thermally transfer the dye-sublimation color inks to the card C. The color inks used herein are of yellow (Y), magenta (M) and cyan (C), which composes three primary colors capable of representing all colors by a subtractive color mixture method.

The first transfer ribbon 12 is formed by repetitively arranging the aforementioned dye-sublimation color inks 12*y*, 12*m* and 12*c* in order on one side (lower surface in FIG. 3) of a strip of film base 122. The area occupied by each color ink corresponds to the surface area of the recording medium (card) to be printed in principle. That is, the extent defined by the length Li and width Wi of each ink area on the film base 122 is substantially equal to the surface area defined by the length Lc and width Wc of the card C. The transfer ribbon 12 wound off from a supply roll 124 is fed through a printing part 16 and wound on a takeup roll 126. The transfer ribbon 12 including the supply roll 124 and takeup roll 126 is contained in a cartridge 120 which can be detachably seated on the printing part 16 by a simple operation.

The first thermal head 14 is fixed to a cover lid 1*a* overlaying partially on the upper portion of the printer body 1. By closing the cover lid 1*a* upon fitting the cartridge 120 into the first printing section S1, the first thermal head 14 is automatically situated at the printing part 16 defined between the supply roll 124 and takeup roll 126 while pressing the first transfer ribbon 12 downward. Thus, the thermal print head 14 comes into contact with the card C fed from the card supply unit 3 to the printing part 16 through the transfer ribbon 12.

The transfer ribbon 12 and the card C together move in the forward direction at the same speed while pressing the transfer ribbon 12 against the card C with the thermal print head 14, and simultaneously, the thermal print head 14 is operated with heating currents I1 corresponding to image data based on a given image. Consequently, one of the dye-sublimation color inks 12*y*, 12*m* and 12*c*, which is located in the frame of the transfer ribbon opposite to the print head 14 at one time, is sublimated with the heat of the print head 14 to be transferred to the card C.

Since multiple color printing is carried out to produce the desired full-color image Pa on the card C by use of the three color inks 12*y*, 12*m* and 12*c*, the card C must pass through the printing part 16 once every color. That is, as indicated by zigzag arrows in FIG. 3, the card C transported from the card supply unit 3 to a print-starting point in the printing part 16 is first printed with the first ink 12*y* while moving in the forward direction, and upon completion of printing with the first ink, the card C is returned to the print-starting point. Then, the card C thus printed is next printed with the second ink 12*m* over the printed pattern with the first ink 12*y*, and upon completion of printing with the second ink, the card C is again returned to the print-starting point. Finally, the card C thus printed with the first inks 12*y* and 12*m* is further printed with the third ink 12*c*, and upon completion of printing with the third ink, the card C is discharged from the printing part 16 toward the card exit 7. As a consequence of multi-color printing, the desired full-color image is produced on the prescribed portion on the card C.

It is preferable to make the film base 122 as thin as possible in order to increase the heat penetrability, so that the inks applied to the film base can be easily affected by the heat generated by the thermal print head 14, thus increasing the image quality of the output result. However, the thickness of the film base 122 would be reduced to 3 to 20 $\mu$m on the real conditions.

The second printing section S2 incorporates a second printing unit 20 comprising a second transfer ribbon 22 to which the monochrome thermal wax-transfer ink 22*a* and the transparent protective layer 22*b* are applied in a line alternatively as touched upon above, and a second thermal print head 24 for thermally transferring the thermal wax-transfer ink 22*a* and protective layer 22*b* to the recording medium (card C). The second transfer ribbon 22 may be optionally provided with a thermally transferable hologram film 22*c*.

The ink 22*a*, protective layer 22*b* and hologram film 22*c* each have the extent substantially equal to the surface area of the card C to be printed.

The transfer ribbon 22 wound off from a supply roll 224 is fed through a printing part 26 and wound on a takeup roll 226. The transfer ribbon 22 including the supply roll 224 and takeup roll 226 is accommodated in a cartridge 220 which can be detachably fitted into the printing part 26 by a simple operation.

The second thermal head 24 is fixed to a cover lid 1*b* overlaying on the upper portion of the printer body 1 other than the portion covered with the aforesaid cover lid 1*a*. By closing the cover lid 1*b* upon setting the cartridge 220 into the second printing section S2, the second thermal head 24 is automatically situated at the printing part 26 defined between the supply roll 224 and takeup roll 226 while pressing the second transfer ribbon 22 downward. Thus, the thermal print head 24 comes into contact with the card C fed from the first printing section S1 to the printing part 26 through the transfer ribbon 22.

The transfer ribbon 22 and the card C together move in the forward direction at the same speed while pressing the transfer ribbon 22 against the card C with the thermal print head 24, and simultaneously, the thermal print head 24 is activated with heating currents I2. Consequently, the thermal wax-transfer ink 22*a*, protective layer 22*b* or hologram film 22*b* are thermally transferred to the card C with the heat of the print head 24.

The thermal wax-transfer ink 22*a* is ordinarily of black color suitable for distinctly depicting two-gradation images such as characters or bar code patterns.

The protective layer 22*b* is generally a plastic thin film and has a function of restraining discoloration of the fugitive dye-sublimation inks printed on the card at the first printing section S1.

The second thermal print head 24 is operated at higher temperatures than that for the first thermal print head 14, because the thermal wax-transfer ink 22*a* for producing the two-gradation images is relatively high in phase transition temperature, wide in range of the phase transition temperature thereof, and tolerant of the heat. Therefore, the film base 222 of the ribbon 22 may be made relatively thick to secure the strength and reliability of the ribbon 22.

As is plain from the foregoing, because of the differences in specific characteristic between the first and second transfer ribbons 12 and 22, these transfer ribbons must function under different conditions such as operating temperature and run-off angle at which each ribbon is separated from the card C immediately after transfer printing.

To perform the thermal transfer printing at both the printing sections S1 and S2 under the optimum conditions, the run-off angle $\theta 1$ of the first transfer ribbon 12 is determined to be larger than the run-off angle $\theta 2$ of the second transfer ribbon 22, i.e. $\theta 1 > \theta 2$, as illustrated in FIG. 3.

Figure 4:
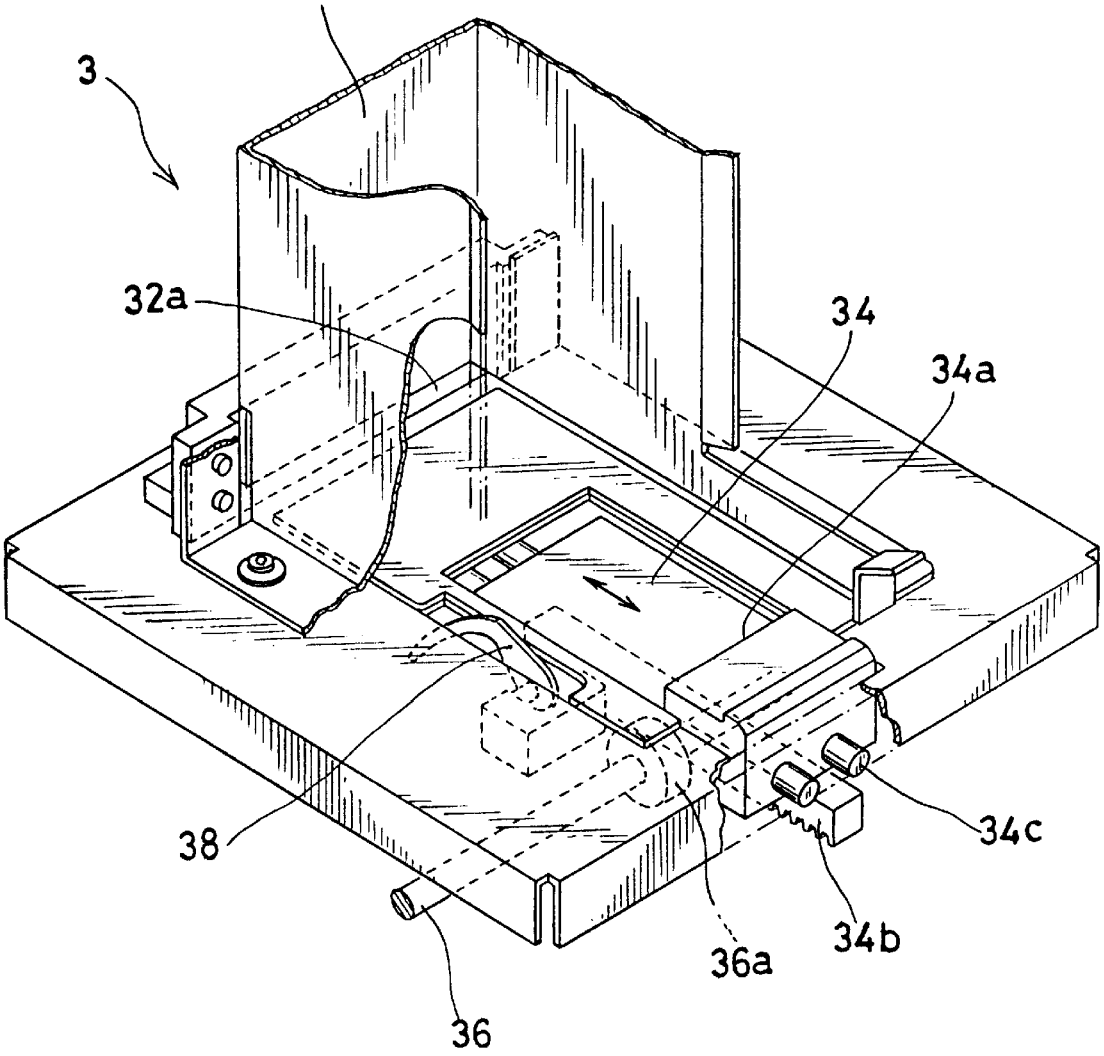
FIG. 4 is a partial cutaway perspective view of the recording medium supply portion in the printer of FIG. 1.

The printing device according to this invention has an ingenious mechanism for enabling the recording medium to be accurately positioned at the printing portion so as to exactly register the color patterns printed with the three dye-sublimation color inks at the first printing section S1. The mechanism for achieving the accurate positioning of the recording medium consists of the card supply unit 3 as well illustrated in FIG. 4 and the printing unit as well illustrated in FIG. 5.

The card supply unit 3 comprises a card stacker 32 in which a plurality of cards C are stacked. The card stacker 32 has a card output slot 32*a* having an aperture height somewhat larger than the thickness of the card and smaller than the thickness of two cards, and a slide carrier 34. The carrier 34 has a catch 34*a* for hooking the rear end of the lowermost of the cards stacked, and a rack 34*b* engaged with a pinion 36*a* on a rotary shaft 36 driven by a motor (not shown). The carrier 34 is slidably moved along guide rods 34*c* by the rotary motion of the pinion 36*a*, thereby to thrust out the lowermost card toward the printing portion through the output slot 32*a*.

In the drawing, reference numeral 38 denotes a card empty sensor for detecting the card existing in the card stacker 32.

Figure 5:
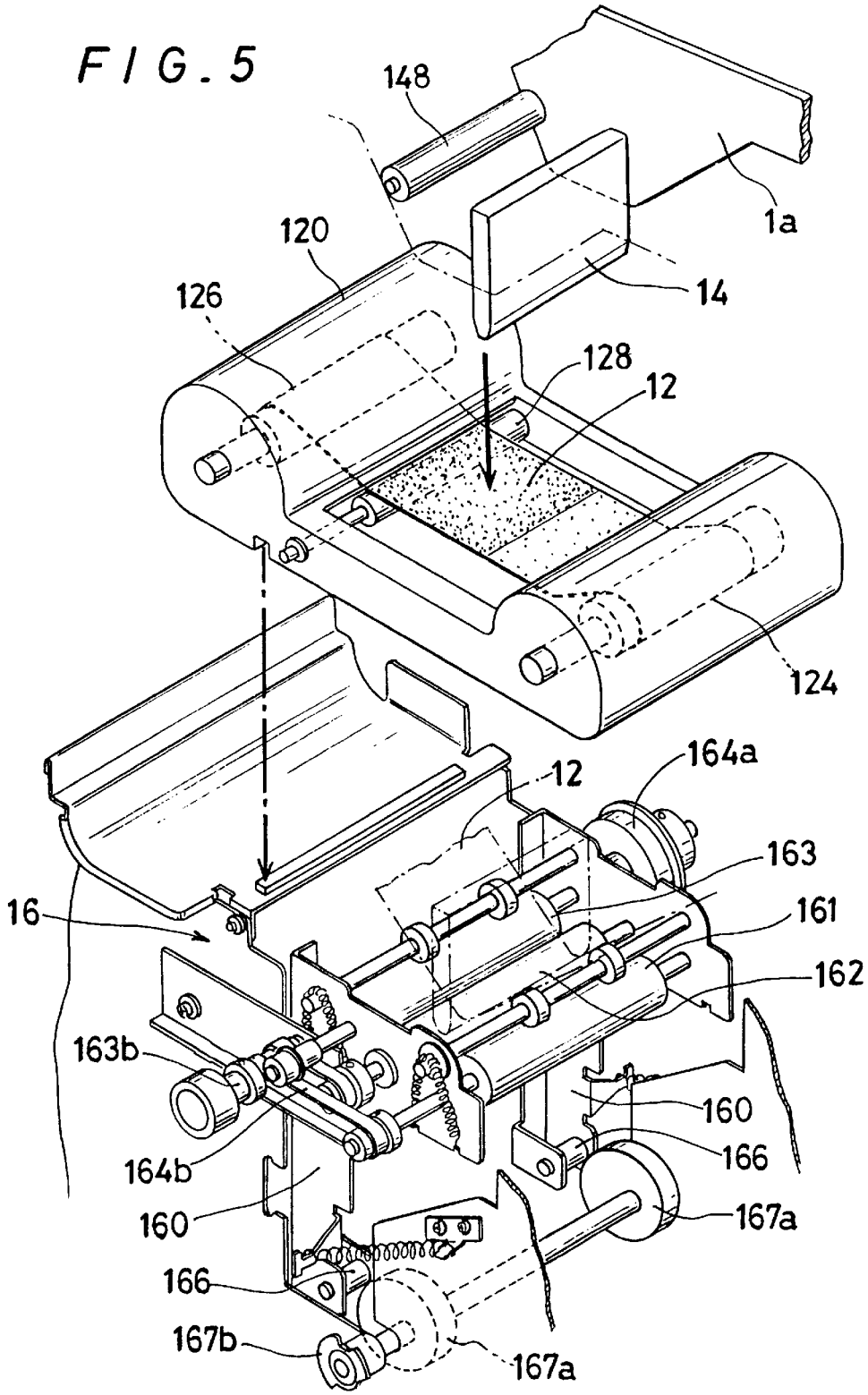
FIG. 5 is a partially sectioned, exploded perspective view of the printing portion in the printer of FIG. 1.

The first printing section S1 representatively illustrated in FIG. 5 is substantially identical with the second printing section S2. The first printing unit 10 has first driving means including an entry-side capstan roller 161, a platen roller 162, and an exit-side capstan roller 163. The capstan rollers 161 and 163 are in contact with pinch rollers 161*a* and 163*a*, respectively.

The capstan roller 163 is retained by a rotary shaft 163*b* rotated by a drive means 164*a*. The rotation of the rotary shaft 163*b* is transmitted to the rollers 161 and 162 through transmitting means 164*b* so as to synchronously rotate the rollers 161 to 163. The drive means 164*a* includes a pulse motor capable of minutely determining its rotational quantity in accordance with the number of current pulses supplied thereto, thus severely controlling the movement of the card C with a high accuracy.

The rollers 161, 161*a*, 162, 163 and 163*a* correspond to rollers 261, 261*a*, 262, 263 and 263*a* of second driving means in the second printing section S2.

The rollers 161, 161*a*, 162, 163 and 163*a* are supported by a substantially L-shaped rocking arm 160 having a horizontal portion and a vertical portion. The rocking arm 160 is constantly urged by a spring 165 so as to force up the horizontal portion. The rocking arm 160 is provided at the lower end of the vertical portion with a cam follower 166. Opposite to the cam follower 166, there is disposed an elliptic cam 167*a* united with an angle detection plate 167*b*, so that the horizontal portion of the rocking arm 160 is rockingly moved around the rotary shaft 163*a* with the rotation of the elliptic cam 167*a*.

The spring 165, cam follower 166, cam 167*a* and angle detection plate 167*b* correspond to elements 265, 266, 267*a* and 267*b* in the second printing section S2, respectively.

The angle detection plate 167*b* has notches which activate and deactivate sensors 167*c* and 167*d* to perceive the rotational posture of the cam 167*a*.

The run-off angle θ1 of the transfer ribbon 12 is determined by a guide roller 128 in conjunction with a guide roller 148 held by the cover lid 1*a*. As was touched on briefly earlier, since the second printing section S2 substantially corresponds to the first printing section S1, the run-off angle θ2 of the second transfer ribbon 22 is determined by a guide roller 228 in contact with a guide roller 248 in the second printing section S2.

Along the transport path 5, there are arranged two pair of transport rollers 152 and 154 (corresponding to rollers 252 and 254 in the second printing section S2), and card sensors Sw1, Sw2 and Sw3.

Figure 6A:
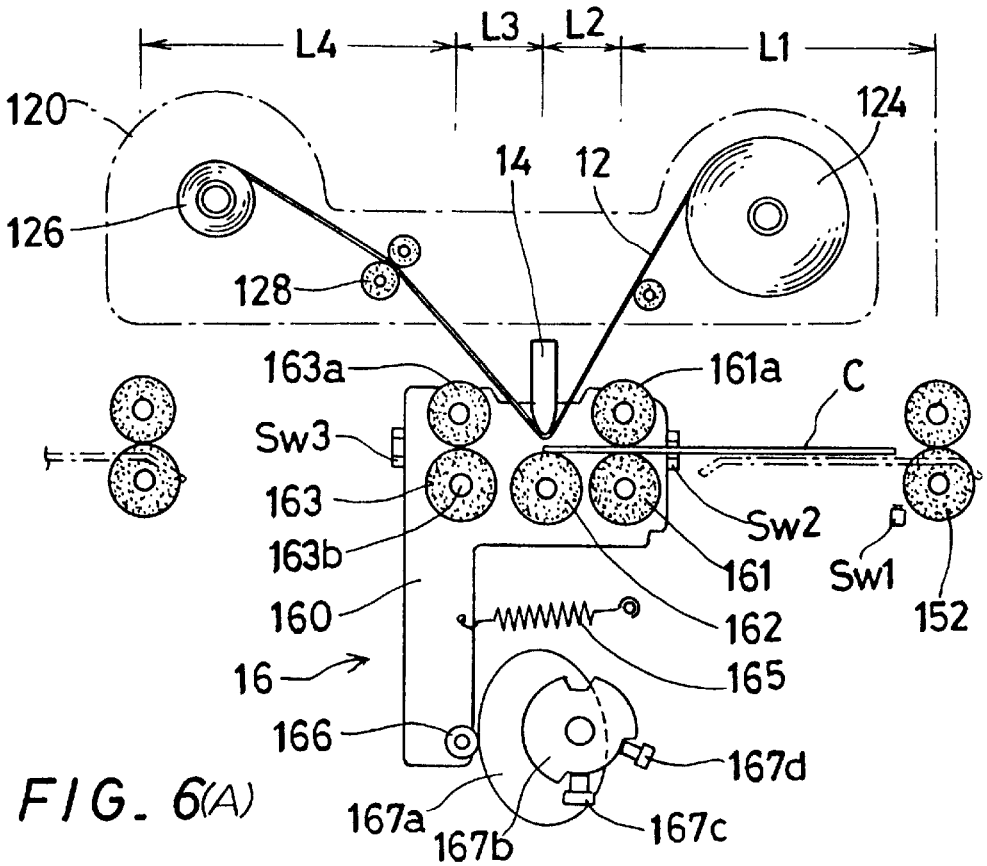
FIGS. 6(A) and 6(B) are schematic side views showing the operating principle of the printing portion of FIG. 1.

The intervals at which the rollers 152, 161, 162, 163 and 154 are respectively separated as shown in FIG. 6(A) are determined by the following formulae:

$$L1 \leqq L < (L1+L2) \quad (1)$$

$$L4 \leqq L < (L3+L4) \quad (2)$$

wherein, L stands for the length of the card; L1 for the interval between the entry-side transfer roller 152 and the capstan roller 161; L2 for the interval between the capstan roller 161 and the platen roller 162; L3 for the interval between the platen roller 162 and the capstan roller 163; and L4 for the interval between the capstan roller 163 and the exit-side transfer roller 154.

As is understood from the formulae (1) and (2) above, when the leading end of the card C fed from the card supply unit 3 located on the right side of FIG. 6(A) reaches the roller 161 and the platen roller 162, the rear end of the card C is released from the transfer rollers 152. Likewise, when the rear end of the card C is still left between the platen roller 162 and the roller 161, the card C is led into between the exit-side transfer rollers 154 to be discharged out from the printing portion.

Figure 6B:
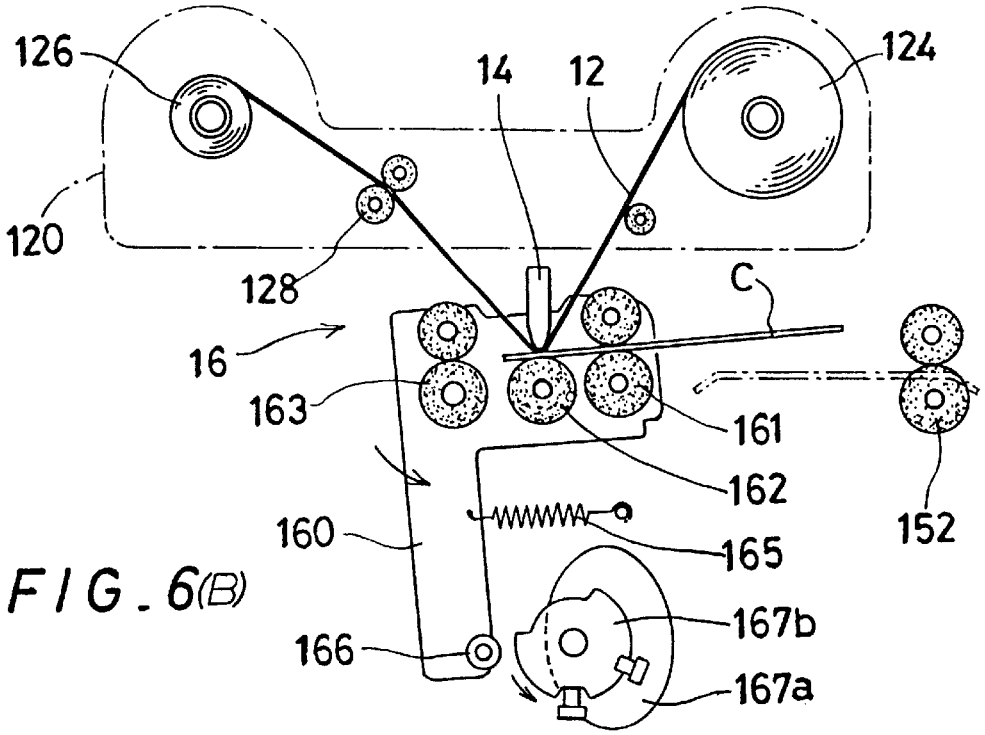

When the front end of a printing area prescribed on the card C arrives at the printing point at which the thermal print head 14 faces the platen roller 162 in the state shown in FIG. 6(A), the cam 167*a* rotates to force the horizontal portion of the rocking arm 160 upward to bring the card into contact with the print head 14 through the transfer ribbon 12 as shown in FIG. 6(B). Then, the card C is forwarded together with the transfer ribbon 12 by rotating the rollers 161, 162 and 163 while being kept in contact with the print head 14 and driving the print head to heat. As a result, the ink on the transfer ribbon 12 is thermally transferred to the card C, thus producing the desired image pattern on the card. Upon completion of printing with one of color inks, the cam 167*a* rotates so as to lower the horizontal portion of the rocking arm 160, thereby separating the card from the print head 14. Then, the rollers 161, 162 and 163 are reversed to return the card to the status quo ante as shown in FIG. 6(A). The same procedure is repeated three times equal to the number of colors to be printed.

The accurate positioning of the card C at the printing point can be attained by starting taking count of pulses of the driving current supplied to the pulse motor when the leading end of the card being reversed is detected by the card sensor Sw3. Thus, high-quality full-color (multiple-gradation) images without suffering color draft can be printed on the card C.

Similarly to the printing procedure in the first printing section S1 as specified above, two-gradation images (black-and-white images) such as character and bar code patterns is printed on the same card with the black thermal wax-transfer ink 22*a*, and further, the card thus printed is coated with the protective layer 22*b* in the second printing section S2.

In the second printing section S2 of the printing device according to this invention, when the line patterns for which the width and intervals of the lines holds significance, such as a bar code pattern, are printed, heating energy Ie (driving pulse and/or voltage) supplied to the thermal print head 24 is adjusted according to the directional situation of the line pattern.

Figure 7:
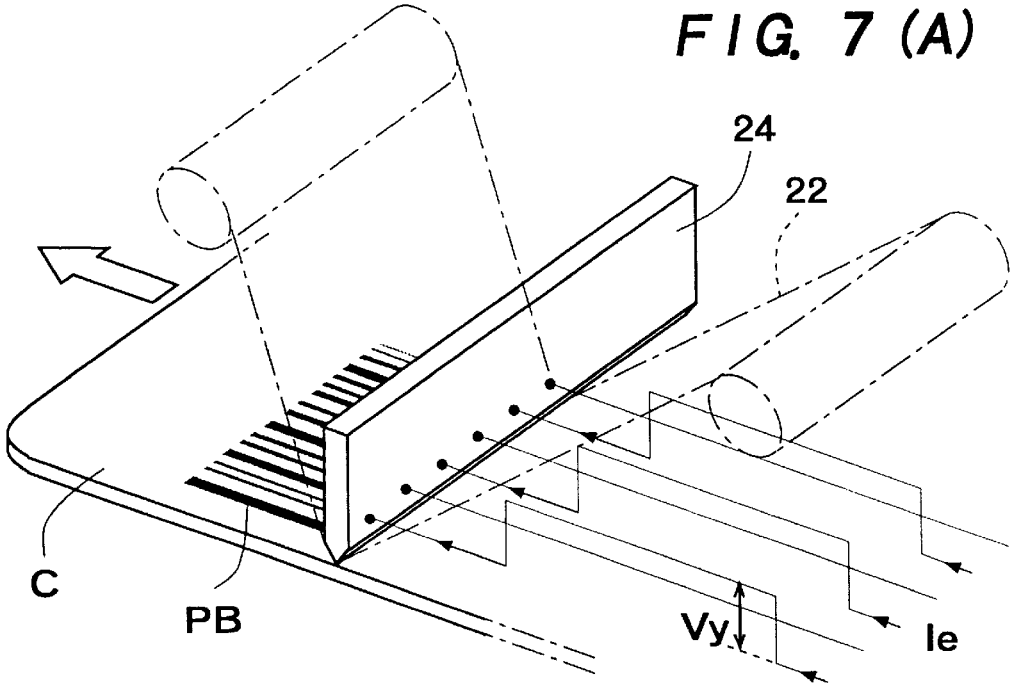
FIGS. 7(A) and 7(B) are views for the explanation of two modes of printing bar code patterns according to this invention.
Figure 7:
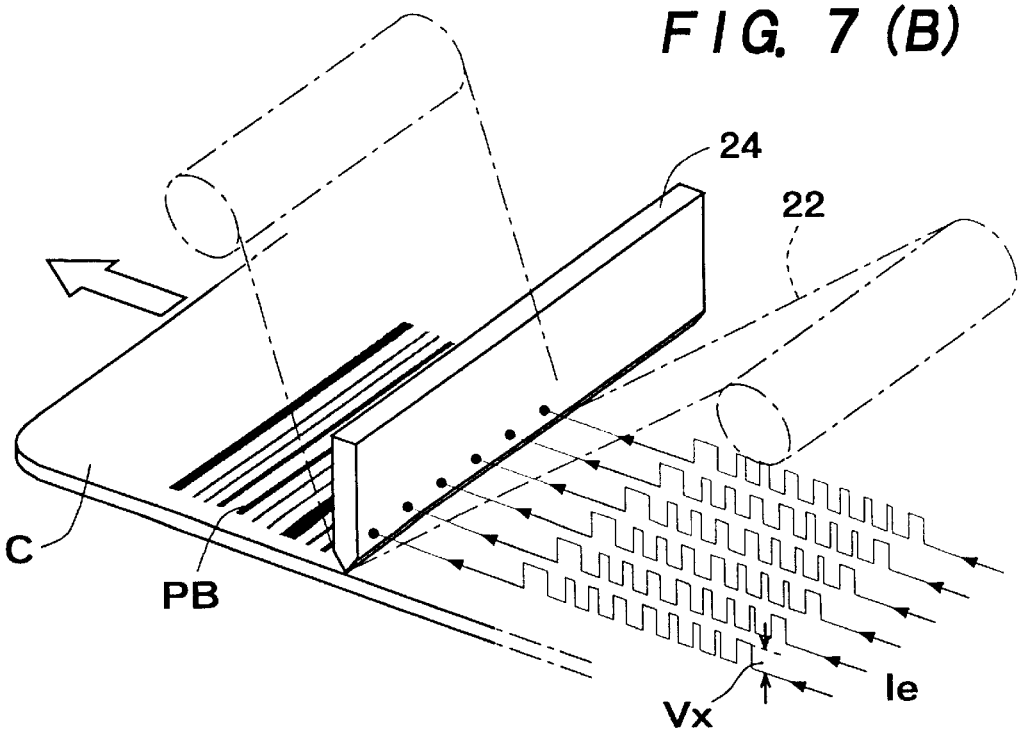

To be specific, compared with the heating Ie supplied to the print head 24 when printing the bar code pattern PB in the lengthwise direction of the constituent lines (code bars) as shown in FIG. 7(A), the heating energy Ie supplied when printing the pattern PB in the widthwise direction as shown in FIG. 7(B) is lowered to some extent. That is to say, the two-gradation image with the lines having specified widths is printed in such a manner that the line is printed in its lengthwise direction at a temperature lower than the temperature at which the line is printed in its widthwise direction.

Consequently, the elaborately specified bar code pattern can be printed on the recording medium without being adversely affected by the heat hysteresis of the heating elements constituting the thermal print head 24.

According to this invention, the directional situation of the bar code pattern to be printed can be automatically recognized in various method, for example, by interpreting rotational angle command, printing area data or bit-map data comprehended in bar code informations delivered from an image processing computer.

Figure 8:
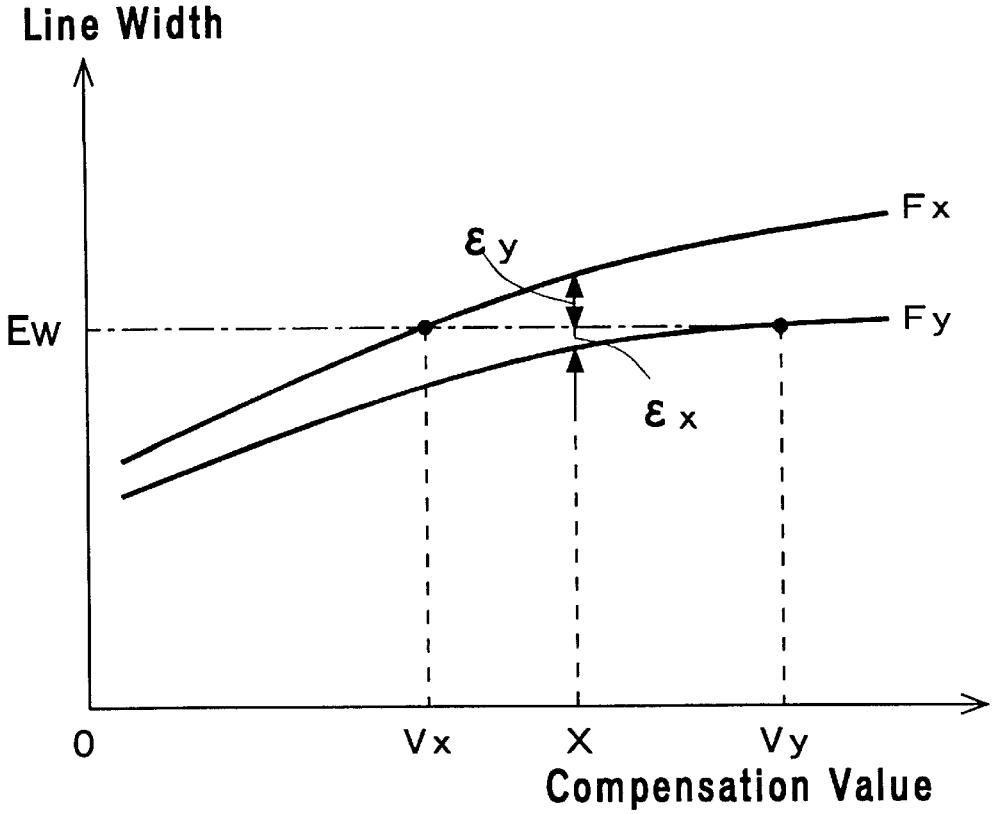
FIG. 8 is a graph showing the characteristics of the results of printing bar code patterns in different directions.
Figure 9:
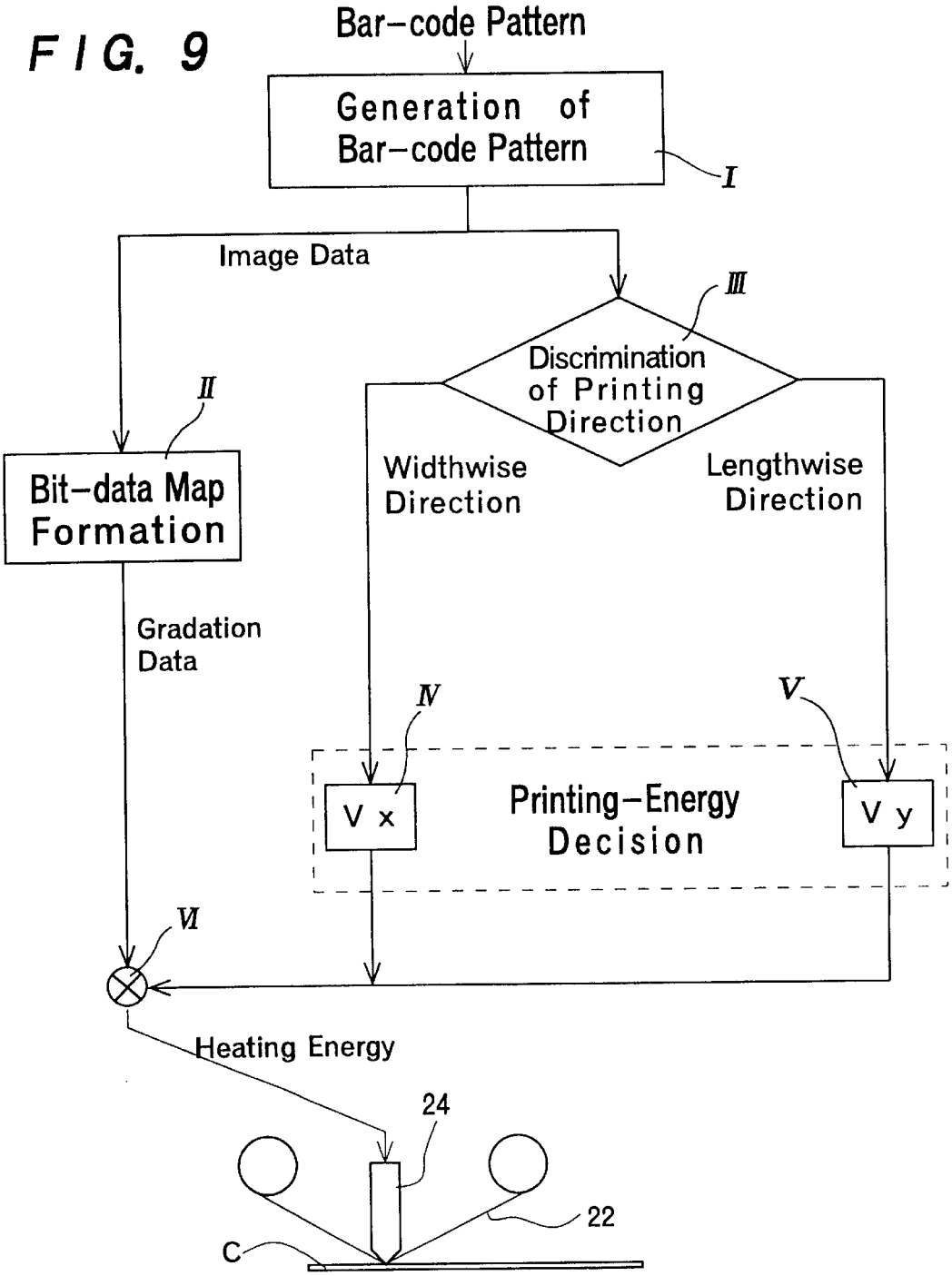
FIG. 9 is a flowchart for explanation of the operation of printing bar code patterns according to this invention.

Upon ascertaining the directional situation of the bar code pattern, heating energy is supplied to the thermal print head 24 in accordance with prescribed energy characteristics as graphically shown in FIG. 8. The characteristic of the energy to be supplied to the thermal print head when printing the bar code pattern in the lengthwise direction of the code bars as shown in FIG. 7(A) is represented by the curve Fy, and that when printing the bar code pattern in the widthwise direction as shown in FIG. 7(B) is represented by the curve Fx. To be more specific, in the case of printing the bar code pattern in the widthwise direction (characteristic curve Fx), a compensation value Vx is automatically determined by designating a desired line width Ew of a reference line prescribed in the bar code pattern to be printed. When printing in the lengthwise direction (characteristic curve Fy), a compensation value Vy is determined in the same manner. Comparatively in a conventional thermal printer, an average energy (x) is unconditionally determined, thus involving inadequate errors $\epsilon x$ and $\epsilon y$.

The processing for compensating the heating energy to be supplied to the thermal print head as described above can be practiced in the following manner.

When a desired bar code are first designated, a bar code pattern is generated in a host computer at the outset (Step I in FIG. 8), and then, a bit-data map for the bar code pattern is formed in a frame memory (Step II). At the same time, the directional situation of the bar code pattern is discriminated (Step III). When printing in the widthwise direction, the compensation value Vx is decided (Step IV), or when printing in the lengthwise direction, the compensation value Vy is decided (Step V). Then, the gradation data for essentially driving the print head 24 is multiplied by either compensation value thus decided and given as the heating energy to the print head 24 (Step VI).

Since the compensation for the heating energy can be fulfilled in various methods, the compensating process as described above should not be understood limitative.

In addition, according to this invention, very high-quality images can be produced on a recording medium without being adversely affected by ununiformity of the heat generated by the heating resistance elements constituting the thermal print head, which is caused due to deviations in specific resistance among the heating resistance elements.

Although the deviations in specific resistance among the heating elements could be corrected by finding the mean or maximum resistance as a reference value from all the heating elements and adjusting each individual heating element on the basis of the reference value, this method is not rational.

Figure 10:
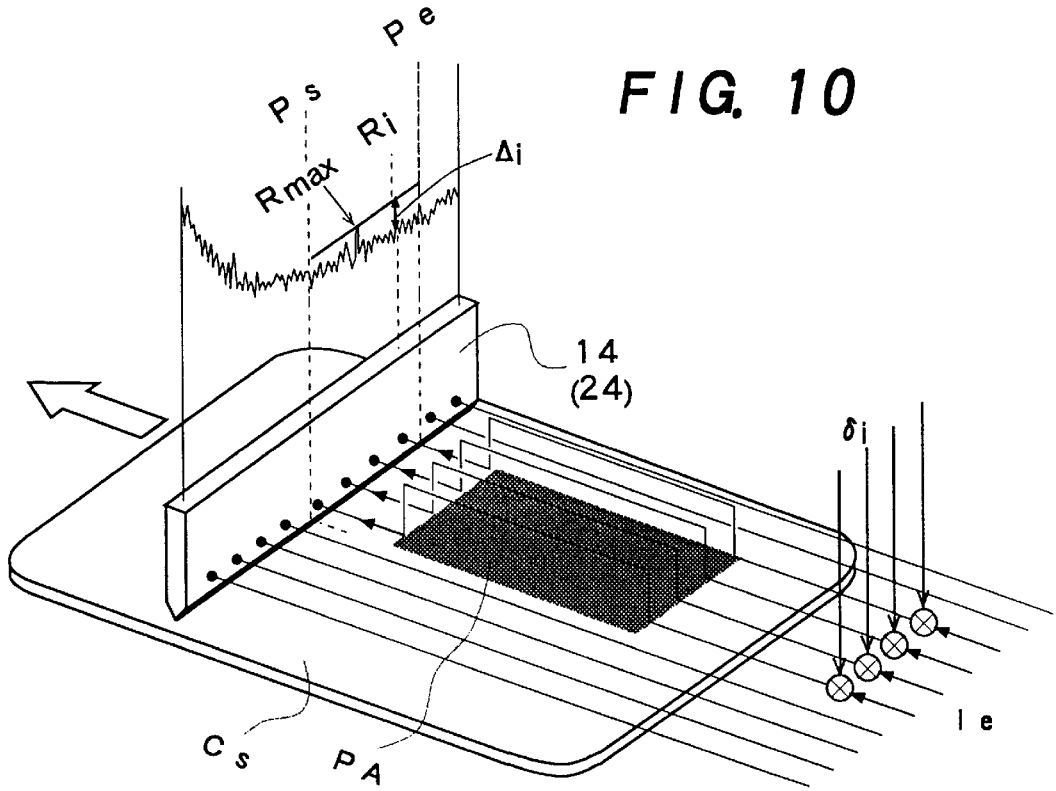
FIG. 10 is an explanatory view conceptually showing the method for compensating deviations in resistance of the thermal print head used in this invention.

Incidentally, printing is seldom performed on the overall surface of a card serving as a recording medium. In most cases, the card Cs is partially printed as shown in FIG. 10. In the illustrated case, it is sufficient to drive only the heating elements of the thermal print head 14 or 24, which are required to heat for printing a printing area PA. That is to say, only the heating elements between the dot locations Ps and Pe may be operated with driving currents Ie, and the remaining heating elements may be out of operation. Upon this, the driving currents Ie are processed by obtaining ratios $\delta i$ of the deviations $\Delta i$ of the resistances Ri of the active heating elements from the dot location Ps to the dot location Pe to the maximum resistance Rmax among the active heating elements, and multiplying the driving currents Ie by the ratios $\delta i$, as conceptually illustrated in FIG. 10. To put it notional, the difference $\Delta i$ between the maximum resistance Rmax and the specific resistance Ri of each heating element is added to the image data representing the gradation at the specified dot of the given image.

Thus, the heating energy Ei to be supplied to the i-th thermal print head is expressed by the following formula:

$$Ei=t(V^2/R)\times\delta i \quad (3)$$

wherein, i stands for the dot-address number of the heating resistance element ($Ps \leqq i \leqq Pe$ in this embodiment); t for the time width of a driving current pulse supplied to the i-th heating element, which corresponds to the grayscale of the i-th dot in a given image; V for the supplied voltage; and R for the resistance of the i-th heating element. The ratio $\delta i$ is expressed by (Ri/Rmax) and serves as the compensation value.

The sample data obtained by compensating the resistivities of the heating elements according to this invention will be shown in Table 1 below.

TABLE 1

| Element Address | Resistivity Ri (Ω) | Ratio δ (=Ri/Rmax) | Output Energy (Ei) |
|---|---|---|---|
| i − 1 | 95 | 0.95 | 100 |
| 1 | 100 (Max.) | 1 | 100 |
| i + 1 | 80 | 0.80 | 100 |
| i + 2 | 85 | 0.85 | 100 |

As will be seen from Table 1 above that, no matter how the heating resistance elements differ in resistivity from one another, the resultant output energy Ei can be made equal by multiplying the driving current to be given to each heating element by the ratio (Ri/Rmax).

Figure 11:
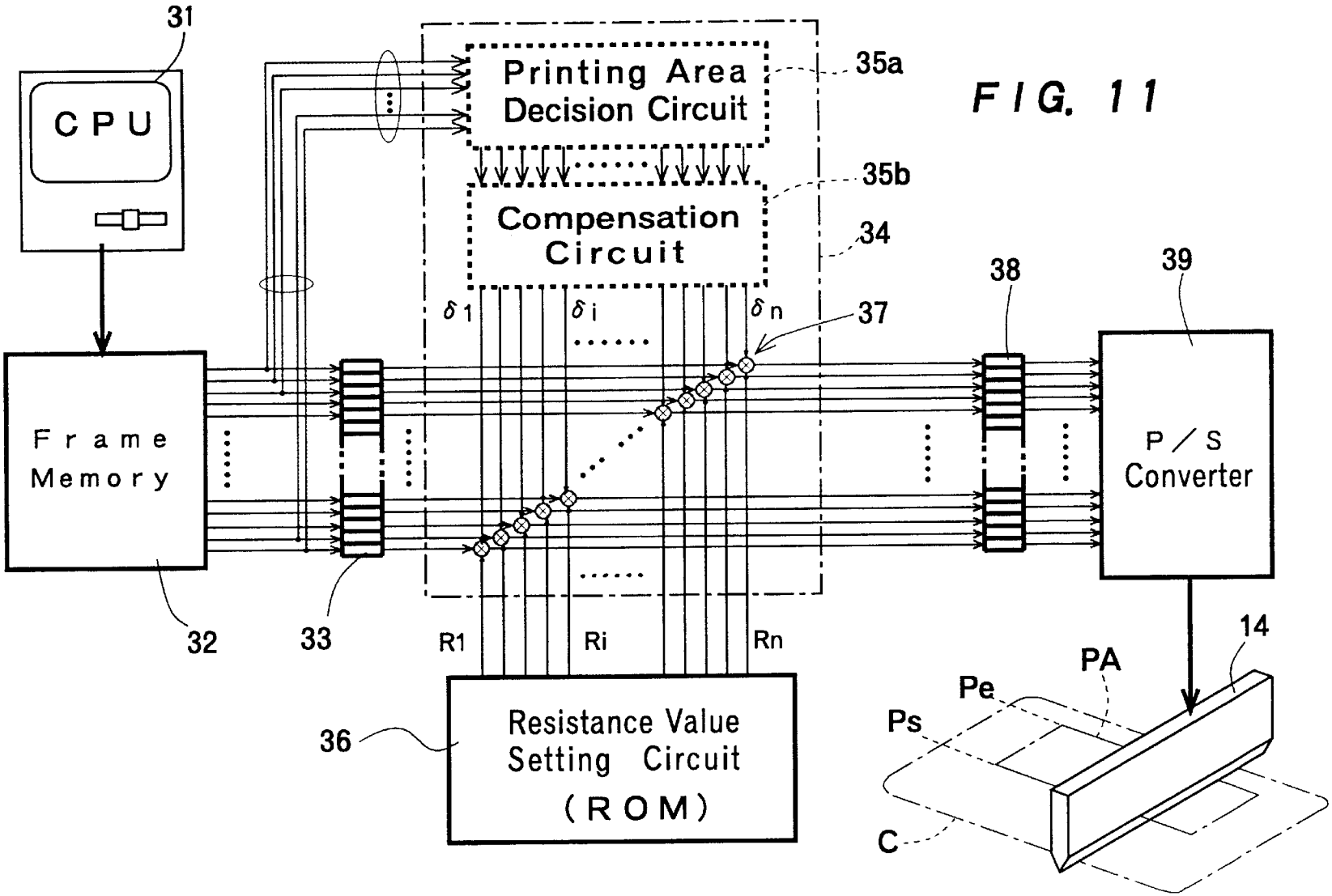
FIG. 11 is a schematic block diagram of compensating means for deviations in resistance of thermal print head according to this invention.

The aforementioned compensation processing can be practiced by a compensating system schematically illustrated in FIG. 11. In this system, image data given by an image processing computer (CPU) 31 are temporarily stored in a frame memory 32 and fed by one frame data to an image-data processor 34 through a line memory 33. The frame data fed to the processor 34 are converted into heating energy values Ei corresponding to the gradations at each dot of the given image data, and simultaneously, the printing area PA prescribed on the card C are discriminated from the given image data by a printing area decision circuit 35*a*, consequently delivering compensation value $\delta i$ (i=1 . . . n) from a compensation circuit 35*a*.

On the other hand, the specific resistance values Ri (i=1 . . . n) of the heating resistance elements constituting the thermal print head 14 are preset in a resistance value setting circuit (ROM) 36 which is usually supplied with a product (print head) manufactured by a print head maker. From the resistance value setting circuit 36, only the resistance values corresponding to the respective heating elements between the dots Ps and Pe defining the printing area PA on the card C may be read out and each multiplied by the corresponding compensation value $\delta i$ delivered from the compensation circuit 35*a*, thereby to compensate the image data representing the gradation at each specified dot of the given image.

The heating energy values resultantly produced are fed to a parallel-to-serial (P/S) converter 39 through a line memory 38 and supplied as driving signals (in the form of current pulse width) to the heating elements of the thermal print head 14 in serial.

According to this embodiment, a high-quality image prescribed in a specific printing area can be rationally produced on the card.

To further improve the image quality of an image to be printed on the card, according to this invention, each of the heating resistance elements constituting the thermal print head can be effectively controlled without suffering the heat hysteresis of adjacent heating elements, so as to produce very high-quality images having sharp and definite outlines.

Figure 12:
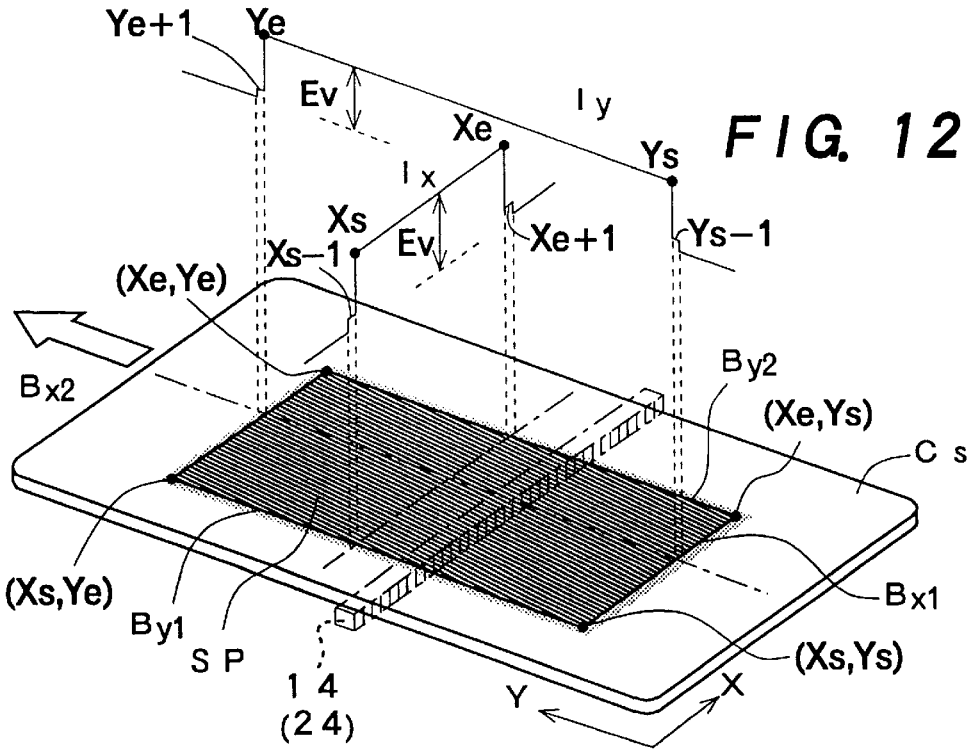
FIG. 12 is an explanatory view conceptually showing the method for sharply depicting the outlines of images according to this invention.

This outline processing is practiced by supplying the minimum heating energy corresponding to the minimum gradation value (zero-grayscale) to the resting heating elements adjacent to the heating elements being operated to depict the outlines of the image, as schematically shown in FIG. 12.

To be concrete, assuming that an image PA is defined by outlines Bx1, By1, Bx2 and By2 connecting four corners given by the coordinates (Xs, Ys), (Xs, Ye), (Xe, Ye) and (Xe, Ys) as illustrated, when depicting the longitudinal outlines By1 and By2, the heating elements at Xs to Xe of the thermal print head 14 are activated to heat with the driving current Ix with energy Ev, and the adjacent heating elements at Xs−1 and Xe+1, which must be fundamentally deactivated, are supplied with the minimum heating energy to generate a little heat. Similarly, when depicting the widthwise outlines Bx1 and Bx2, the heating elements at Xs to Xy of the print head 14 moving in the lengthwise direction of the card Cs continue to be heated with the driving current Iy (equivalent to Ix) with energy Ev within the limits from Ys to Ye, but they are activated with the minimum heating energy only at the time that the print head 14 is at the points Ys−1 and Ye+1.

The outside portions adjacent to the outlines which are depicted with the minimum heating energy are quite unobtrusive because the print by the minimum heating energy is of zero-grayscale in gradation. This outline processing can be also accomplished by the system shown in FIG. 11.

As is apparent from the foregoing description, according to this invention providing a high-performance thermal printer in which the first printing unit for printing by use of the dye-sublimation inks and the second printing unit for printing by use of the thermal wax-transfer ink are separated, high-quality photorealistic full-color images and two-gradation monochrome images such as character and line patterns can be effectively produced on a recording medium. Besides, since the widths of lines or code bars constituting a bar code pattern can be effectively corrected, high-quality patterns having significant meanings in line width and interval can be produced with a high accuracy, regardless of the directional situations of the patterns. Furthermore, since deviations in resistance of heating resistance elements constituting a thermal print head can be compensated to a high degree by use of a simple processing system, high-quality and sharp images with smooth grays and true gradations can be produced.

As can be readily appreciated, it is possible to deviate from the above embodiments of the present invention and, as will be readily understood by those skilled in this art, the invention is capable of many modifications and improvements within the scope and spirit thereof. Accordingly, it will be understood that the invention is not to be limited by these specific embodiments, but only by the scope and spirit of the appended claims.

What is claimed is:

1. A thermal transfer printing method for producing at least one multi-gradation color image and at least one two-gradation image on a recording medium comprising:

feeding said recording medium to a first printing section, printing said at least one multi-gradation color image on said recording medium with dye-sublimation inks of different colors by operating a first thermal print head under a first heating condition suitable for thermally transferring said dye-sublimation inks to produce said at least one multi-gradation image in said first printing section, forwarding said recording medium from said first printing section to a second printing section, printing said at least one two-gradation image on said recording medium with a thermal wax-transfer ink by operating a second thermal print head under a second heating condition different from said first heating condition in said second printing section, said second heating condition being suitable for thermally transferring said thermal wax-transfer ink to produce said at least one two gradation image, and thermally transferring a protective layer to said recording medium in said second printing section.

2. A thermal transfer printing method for producing at least one multi-gradation color image on a recording medium and at least one two-gradation image on said recording medium comprising:

feeding said recording medium to a first printing section including a first thermal print head composed of heating resistance elements each having a specific resistance value, finding a maximum resistance value from said specific resistance values of said heating resistance elements to be printed on said recording medium, obtaining ratios of said heating resistance elements to be printed on said recording medium to said maximum resistance value, multiplying heating energy values to be supplied to said heating resistance elements to be printed on said recording medium by said ratios, to produce compensation heating currents for compensating for deviations in specific resistance among said heating resistance elements, printing said at least one multi-gradation color image on said recording medium with dye-sublimation inks of different colors by supplying said compensation heating currents to said heating resistance elements of said first thermal print head under a first heating condition suitable for thermally transferring said dye-sublimation inks to produce said at least one multi-gradation color image in said first printing section, forwarding said recording medium from said first printing section to a second printing section, and printing said at least one two-gradation image on said recording medium with a thermal wax-transfer ink by operating a second thermal print head under a second heating condition different from said first heating condition in said second printing section, said second heating condition being suitable for thermally transferring said thermal wax-transfer ink to produce said at least one two-gradation image.

3. A thermal transfer printing method according to claim 2, comprising the further step of coating said recording medium printed in said second printing section with a protective layer.

4. A thermal transfer printing method for producing at least one multi-gradation color image on a recording medium and at least one two-gradation image on said recording medium comprising the steps of:

feeding said recording medium to a first printing section including a first thermal print head composed of heating resistance elements each having a specific resistance value, finding a maximum resistance value from said specific resistance values of said heating resistance elements to be printed on said recording medium, obtaining ratios of said heating resistance elements to be printed on said recording medium to said maximum resistance value, multiplying heating energy values to be supplied to said heating resistance elements to be printed on said recording medium by said ratios, to produce compensation heating currents for compensating for deviations in specific resistance among said heating resistance elements, printing said at least one multi-gradation color image on said recording medium with dye-sublimation inks of different colors by supplying said compensation heating currents to said heating resistance elements of said first thermal print head under a first heating condition suitable for thermally transferring said dye-sublimation inks to produce said at least one multi-gradation color image in said first printing section, forwarding said recording medium from said first printing section to a second printing section, printing said at least one two-gradation image on said recording medium with a thermal wax-transfer ink by operating a second thermal print head under a second heating condition different from said first heating condition in said second printing section, said second heating condition being suitable for thermally transferring said thermal wax-transfer ink to produce said at least one two-gradation image, and thermally transferring a transferable hologram film to said recording medium in said second printing section.

5. A thermal transfer printing method for producing at least one image having outlines on a printing area on a recording medium comprising:

feeding said recording medium to a first printing section including a first thermal print head composed of heating resistance elements, finding a maximum resistance value from specific resistance values of said heating resistance elements to be printed on said printing area, printing at least one multi-gradation color image on said recording medium with dye-sublimation inks of different colors by operating a first thermal print head under a first heating condition in said first printing section, forwarding said recording medium from said first printing section to a second print section including a second thermal print head composed of heating resistance elements, finding a maximum resistance value from specific resistance values of said heating elements of said second thermal print head, and printing in said second printing section at least one two-gradation image on said recording medium with a thermal wax-transfer ink by operating said second thermal print head under a second heating condition different from said first heating condition, wherein said images produced in said first and/or second printing section are printed while depicting the outlines by operating said heating resistance elements of said first and/or second thermal print heads opposite to said outlines and simultaneously operating the heating resistance elements adjacent said heating resistance elements opposite to said outlines with driving currents having minimum gradation values.

6. A thermal transfer printing method according to claim 5, comprising the further step of coating said recording medium printed in said second printing section with a protective layer.

7. A thermal transfer printing method according to claim 5, comprising the further step of thermally transferring a transferable hologram film to said recording medium in said second printing section.

8. A thermal transfer printing device comprising:

a first printing unit including a first transfer ribbon with dye-sublimation inks of different colors in order, and a first thermal print head for heating said first transfer ribbon to thermally transfer said dye-sublimation inks to a recording medium under a first heating condition; and a second printing unit disposed apart from said first printing unit and including a second transfer ribbon with thermal wax-transfer ink and/or a protective layer, and second thermal print head for thermally transferring said thermal wax-transfer ink and/or protective layer to said recording medium fed from said first printing unit under a second heating condition different from said first heating condition wherein said second transfer ribbon includes a thermally transferable, hologram film.

9. A thermal transfer printing device according to claim 8, wherein said first transfer ribbon is separated from said recording medium at a first run-off angle after printing in said first printing unit, and said second transfer ribbon is separated from said recording medium at a second run-off angle after printing in said second printing unit, said first run-off angle being larger than said second run-off angle.

10. A thermal transfer printing device comprising:

a first printing unit including a first cartridge accommodating a first transfer ribbon with dye-sublimation inks of different colors arrayed in order, and a first thermal print head for heating said first transfer ribbon to thermally transfer said dye-sublimation inks to a recording medium under a first heating condition;

first driving means for transporting said recording medium and pressing said recording medium against said first thermal print head through said first transfer ribbon;

a second printing unit disposed apart from said first printing unit and including a second transfer ribbon with a thermal wax-transfer ink and/or a protective layer, and a second thermal print head for thermally transferring said thermal wax-transfer ink and/or protective layer to said recording medium fed from said first printing unit under a second heating condition different from said first heating condition; and second driving means for transporting said recording medium fed from said first printing unit and pressing said recording medium against said second thermal print head through said second transfer ribbon wherein said second transfer ribbon includes a thermally transferable hologram film.

11. A thermal transfer printing method for producing at least one multi-gradation color image and at least one two-gradation image on a recording medium comprising:

feeding said recording medium to a first printing section, printing the multi-gradation color image on said recording medium with dye-sublimation inks of different colors by operating a first thermal print head under a first heating condition in said first printing section, forwarding said recording medium from said first printing section to a second print section, printing the two-gradation image on said recording medium with a thermal wax-transfer ink by operating a second thermal print head under a second heating condition different from said first heating condition in said second printing section, and thermally transferring a protective layer to said recording medium in said second printing section wherein said at least one two-gradation image includes lines having specified widths, each line being printed in its length wise direction at a first temperature and in its width wise direction at a second temperature lower than said first temperature.

12. A thermal transfer printing method according to claim 11, wherein said at least one two-gradation image is a bar code pattern.

13. A thermal transfer printing device comprising:

a first unit including a first transfer ribbon coated with dye-sublimation inks of different colors in order, and a thermal print head for heating said first transfer ribbon to thermally transfer said dye-sublimation inks onto a recording medium to print at least one multi-gradation color image on said recording medium with said dye sublimation inks by operating said thermal print head; and a second unit including a second transfer ribbon coated with a hologram film and means for transferring said hologram film onto said recording medium fed from said first unit, on which said at least one multi-gradation color image is printed with said dye-sublimation inks;

wherein said dye-sublimation inks are heated at a first heating temperature suitable for thermally transferring said dye-sublimation inks to the recording medium in said first unit, and said hologram film is heated at a second heating temperature suitable for thermally transferring said hologram film to said recording medium in said second unit.

14. A thermal transfer printing device comprising:

a first unit including a first transfer ribbon coated with dye-sublimation inks of different colors in order, and a thermal print head for heating said first transfer ribbon to thermally transfer said dye-sublimation inks onto a recording medium to print at least one multi-gradation color image on said recording medium with said dye-sublimation inks by operating said thermal print head; and a second unit including a second transfer ribbon coated with a hologram film and a protective layer and means for transferring said hologram film and said protective layer onto said recording medium fed from said first unit, on which said at least one multi-gradation color image is printed with said dye-sublimation inks;

wherein said dye sublimation inks are heated at a first heating temperature suitable for thermally transferring said dye-sublimation inks to the recording medium in the first unit and the hologram film and said protective layer are heated at a second heating temperature suitable for thermally transferring said hologram film and said protective layer to the recording medium in said second unit.

* * * * *